United States Patent [19]

Spencer

[11] 4,285,621

[45] Aug. 25, 1981

[54] APPARATUS FOR STACKING PRODUCT

[75] Inventor: Harvey J. Spencer, Green Bay, Wis.

[73] Assignee: Paper Converting Machine Company, Green Bay, Wis.

[21] Appl. No.: 93,994

[22] Filed: Nov. 14, 1979

[51] Int. Cl.[3] ..... B65H 29/34

[52] U.S. Cl. ..... 414/45; 414/47; 414/52; 414/79; 414/900; 198/419; 198/422; 198/626; 198/652; 271/217

[58] Field of Search ..... 414/45, 47, 52, 78, 414/79, 83, 98, 900; 198/419, 422, 626, 812, 813, 652; 271/217, 218, 219, 189, 192

[56] References Cited

U.S. PATENT DOCUMENTS

| | | | |
|---|---|---|---|
| 2,010,732 | 8/1935 | Mandusic | 414/79 |
| 2,166,447 | 7/1939 | Ruppenthal | 198/812 |
| 3,254,889 | 6/1966 | Nystrand et al. | 271/69 |
| 3,420,386 | 1/1969 | Morrow et al. | 414/45 |
| 3,498,600 | 3/1970 | Spencer et al. | 271/69 |
| 3,591,018 | 7/1971 | Nalbach | 271/218 X |
| 3,599,805 | 8/1971 | Spencer et al. | 414/83 X |
| 3,599,807 | 8/1971 | Hedrick et al. | 414/52 X |
| 3,643,816 | 2/1972 | Jacobsen | 271/218 X |
| 3,718,267 | 2/1973 | Hiebert et al. | 414/79 X |

*Primary Examiner*—Leslie J. Paperner

*Attorney, Agent, or Firm*—Tilton, Fallon, Lungmus & Chestnut

[57] ABSTRACT

Apparatus for stacking web units involving a transfer mechanism to accumulate substacks when traveling in a vertical path and including L-shaped fingers for supporting the stacks in the vertical path.

10 Claims, 5 Drawing Figures

FIG. 4
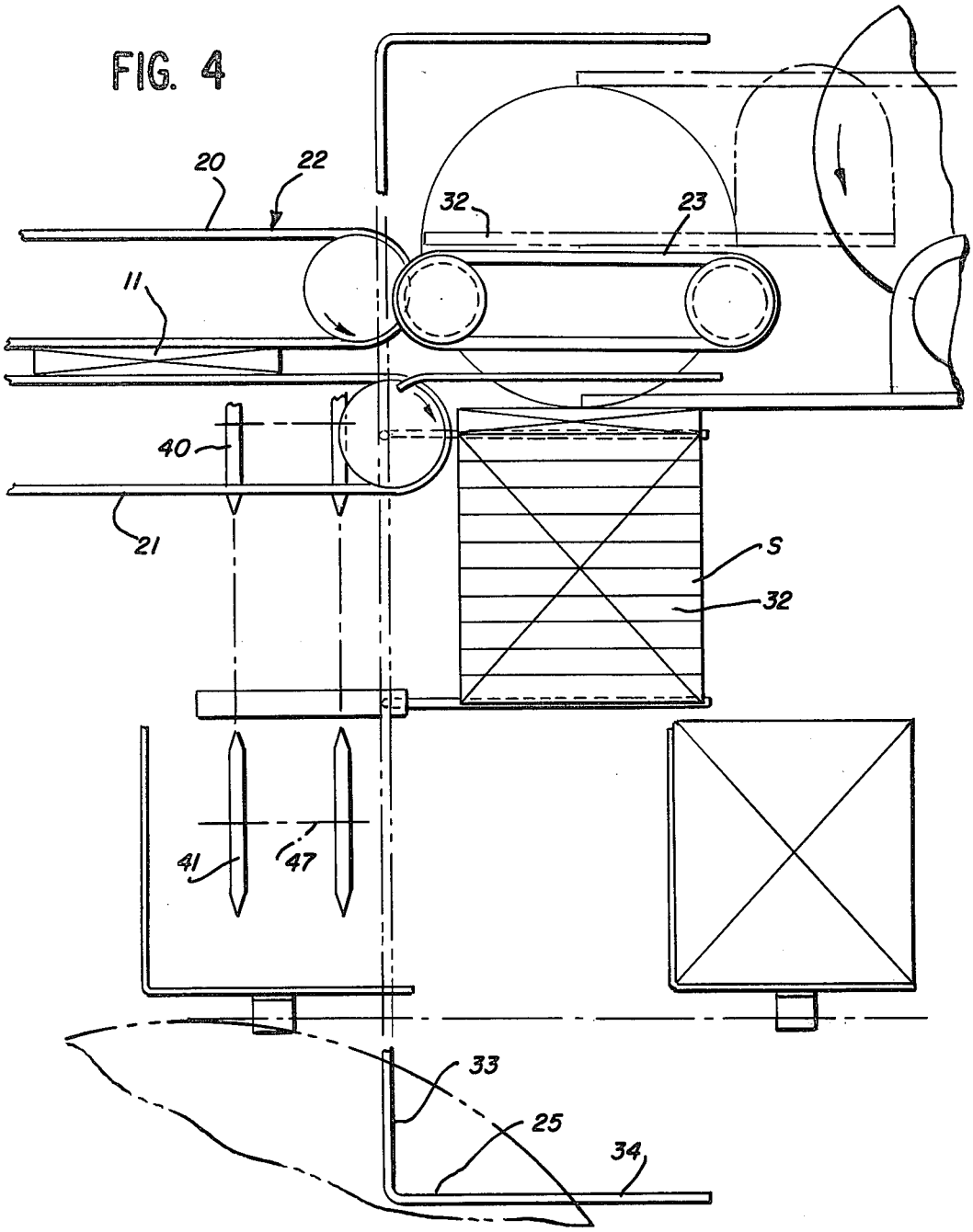
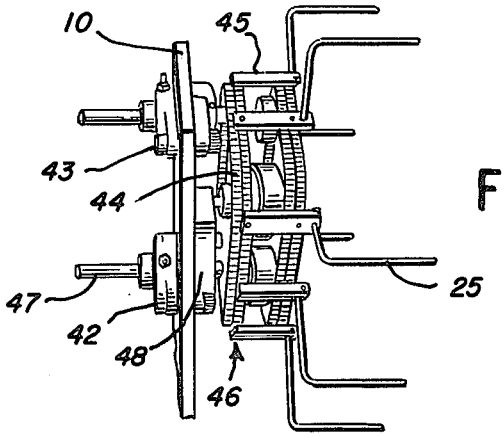
FIG. 5

APPARATUS FOR STACKING PRODUCT

BACKGROUND AND SUMMARY OF INVENTION

This invention relates to apparatus for stacking product such as web units and, more particularly, for accumulating substacks of web units into larger stacks while the same are traveling vertically between two vertically spaced apart horizontal paths.

A great variety of mechanisms have been employed in the past for accumulating web units such as tissues, towels, diapers, etc., into larger stacks or accumulations. Not only have these mechanisms been complex and therefore expensive, but their very complexity often led to speed limitations. Illustrative of apparatus employed for stacking web units in the past are U.S. Pat. Nos. 3,599,805 and 3,254,889.

According to the instant invention, a simplified, reliable and high-speed stacking apparatus is provided. It can be used in an environment which includes means for advancing sub-stacks of superposed web units along a horizontal path and then through a vertical path to a horizontally traveling receiving and takeaway conveyor. The instant invention brings to that environment a pair of transfer finger mechanisms which are positioned one on each side of the horizontal path, the mechanisms each carrying a plurality of L-shaped fingers with means on the mechanisms for moving the fingers thereof through a generally obround orbit intersecting the horizontal path slightly inwardly of the sides thereof and serving to define the vertical path of accumulation.

While the rotary counting-stacking and accumulating mechanism is illustrated in combination with a converting machine that delivers substacks or a plurality of stacked sheets to the mechanism, it should be understood because of the advantageous arrangement of the parts, particularly the rotary fingers, the invention can also be arranged to receive substacks comprising a plurality of sheets or single sheets that are to be accumulated into a plurality of webs, i.e., a substack. In any case, the substack or plurality of webs rests upon each pair of coacting and oppositely extending support fingers. This is especially advantageous when the rotary count-stacking and accumulating mechanism is driven by intermittent means, for example, and indexing drive. In any event, the invention provides a much faster and more versatile operation than web segment delivery apparatus such as seen in co-owned U.S. Pat. No. 3,498,600.

Other attributes, advantages and objects of the invention may be seen in the details of the ensuing description.

DETAILED DESCRIPTION

The invention is described in conjunction with an illustrative embodiment in the accompanying drawing, in which FIG. 1 is a fragmentary side elevational view, partially schematic, of the invention in the above described environment;

FIG. 4 is an enlarged fragmentary side elevational view corresponding to the central portion of FIG. 1 and featuring the transfer mechanism; and FIG. 5 is a different perspective view of the form of transfer mechanism of FIG. 3 and which is viewed essentially in the same direction as the transfer mechanism of FIG. 4.

Figure 1:
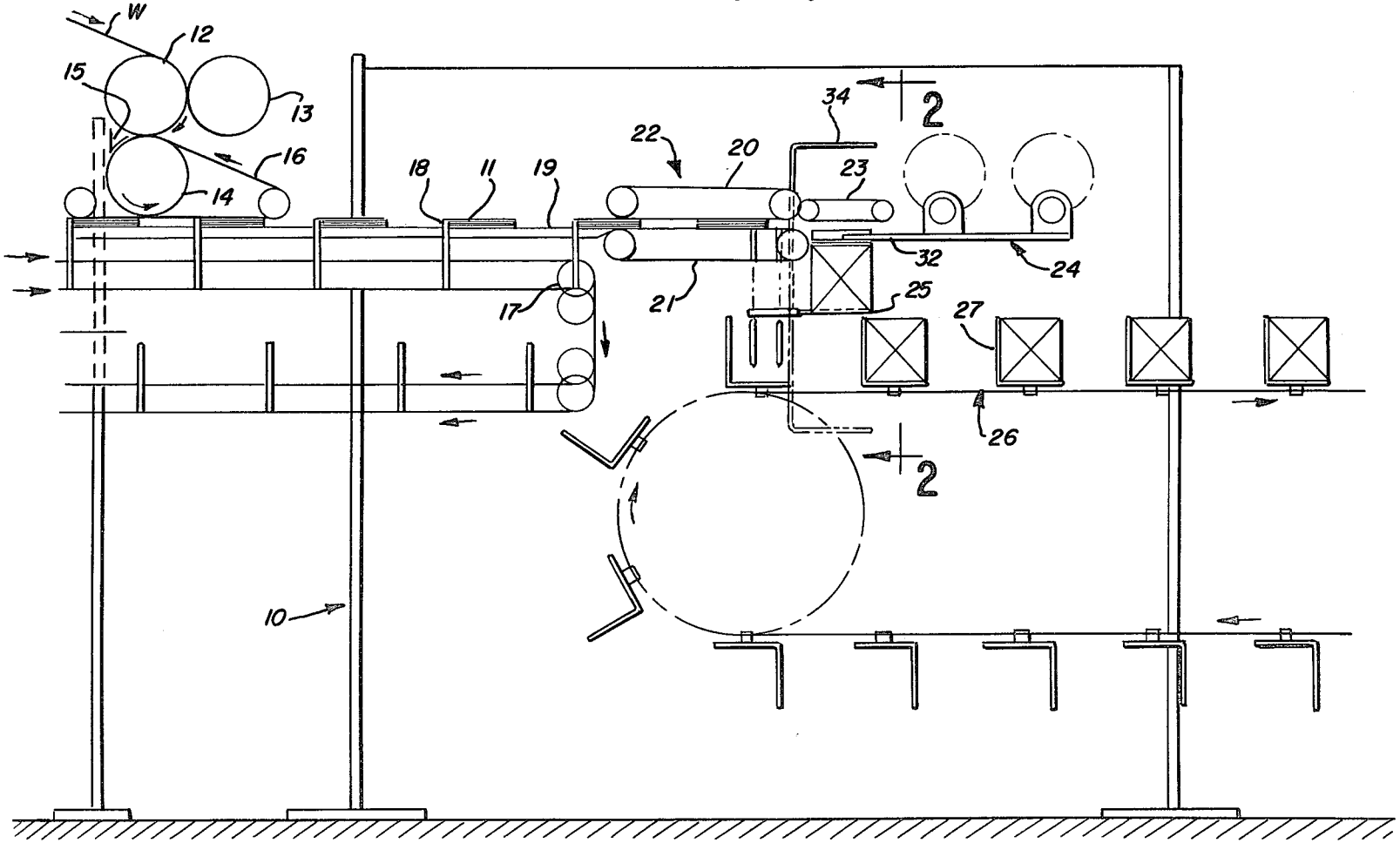

In the illustration given, and with reference first to FIG. 1, the numeral 10 designates generally the frame of a paper converting machine which in this instance is arranged for providing stacks of 100 folded tissues. Initially, the tissues or web units are collected into substacks 11 of ten units each.

For example, the web W which forms the tenth web unit (see the upper left hand portion of FIG. 1) is advanced around a carrier roll 12 and past a cutoff roll 13. Thereafter, in combination with the folding roll 14 a partially folded web unit 15 is developed which is stripped from the vacuum folding roll 14 by means of a belt transfer mechanism 16—this in time with the advance of a collection conveyor 17 equipped with pushers 18. Thus, by traveling a number of webs W through a similar number of roll units 12–14, the substacks 11 are generated. These are advanced along a horizontal path defined by the collection conveyor 17 in spaced apart relation.

As each substack 11 reaches the end of the collection conveyor 17, further travel of the substacks in the horizontal path 19 is achieved by a pair of endless belts 20 and 21 making up a first horizontally traveling conveyor generally designated 22.

Still referring to FIG. 1, the substacks are transferred by means of a second endless belt conveyor 23 to the top of a vertical path. The substacks 11 are removed from the influence of the second conveyor 23 by an orbital packer mechanism generally designated 24 and thereafter caused to be stacked on fingers 25 of a transfer mechanism.

As the fingers 25 descend, they ultimately intersect the path of a receiving and takeaway conveyor generally designated 26 and which is equipped with buckets 27 for removing a now completely assembled stack to a packaging station (not shown).

Figure 2:
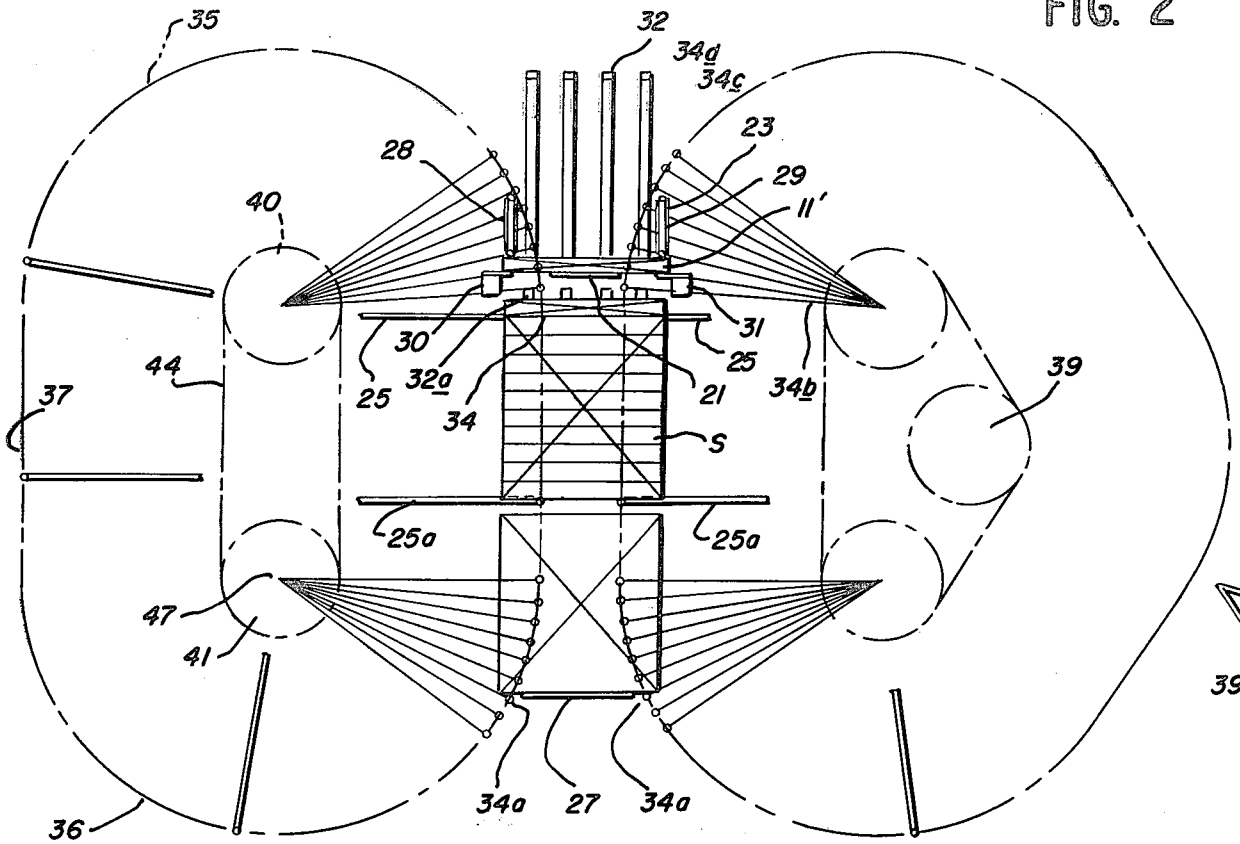
FIG. 2 is a sectional view, again somewhat schematic, of the transfer mechanism portion of FIG. 1 and as would be seen along the sight line 2—2 applied to FIG. 1.

Reference is now made to FIGS. 2 and 4 which illustrate in somewhat larger scale the apparatus at the top of the vertical path defined by the movement of the fingers 25. In the upper left hand portion of FIG. 4, the delivery ends of the endless belts 20 and 21 can be seen. A substack 11 is about to be discharged from this first conveyor 22 into the second conveyor 23.

Now referring to FIG. 2, a substack 11' is seen to be under the influence of the second conveyor 23 which is defined by horizontally spaced apart endless belts 28 and 29 which bear against the top sides of the substack 11' and move the same while it is supported on rails 30 and 31 suitably supported on the frame 10. In FIG. 2, the movement of the substack 11' is out of the paper, i.e., toward the eye of the viewer. Also in FIG. 2, a portion of the first conveyor 22 is shown, this being the upper run of the lower endless belt 21. From this, it can be appreciated that the substack 11 while under the influence of the first conveyor 22 is supported in the central portion thereof and then when it comes under the influence of the second conveyor 23, i.e., in the position designated 11', is supported along its longitudinal edges. Thus, there is an open central portion of the substack which accommodates both the orbital packer 24 and the supporting fingers 25 of the transfer mechanisms.

Next occurring in the operational sequence—that is when the substack 11' is directly above the vertical stacking path occupied by the stack S (see FIG. 4 in the central portion thereof) is the transfer of the substack 11' from the second conveyor 23 downwardly by the fingers 32 of the orbital packer 24. As can be appreciated from FIG. 1, the orbital packer includes a pair of cranks schematically represented which move the finger 32 in circular orbits. This results in deforming the substack 11' slightly by depressing the central portion thereof so as to disengage the longitudinal side edges from the rails 30 and 31 as well as removing them from the influence of the endless belts 28 and 29.

Meanwhile the fingers 25 of the transfer mechanisms have moved into position to receive and support a plurality of substacks. For example, referring to FIG. 2, it will be noted that a prior pair of fingers 25*a* are seen supporting a stack S of ten substacks, i.e., 100 web units. So, in the illustration given, a new set of supporting fingers 25 move into the vertical stacking path 32 every tenth operation of the orbital packer 24. A greater or lesser number of substacks can be accumulated on the packer fingers 25 as desired.

In FIG. 2, the upper set of fingers 25 are seen receiving the first substack 11' under the influence or actuation of the packer fingers in the nadir of their orbit and as is designated 32*a*.

Figure 3:
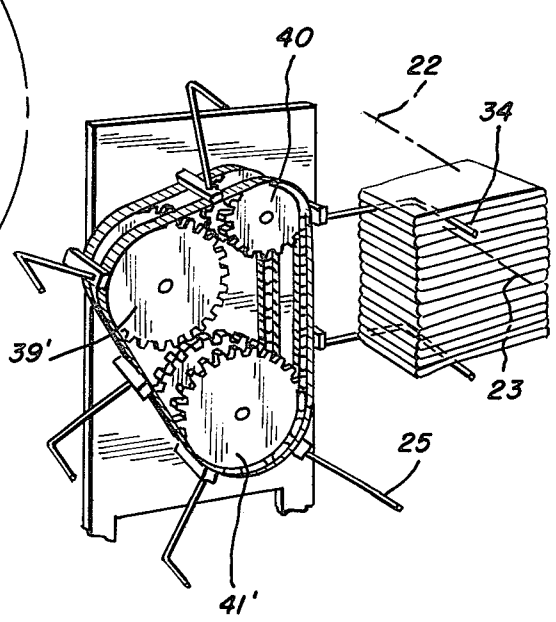
FIG. 3 is a reduced size perspective view of a modified form of one transfer mechanism.

To implement the entry of the fingers 25 into the vertical path 32, the fingers are L-shaped as can be best appreciated from the perspective views seen in FIGS. 3 and 5. More particularly (now referring to FIG. 4 and in the extreme lower portion thereof) each finger 25 is seen to have a radially extending part 33 and a horizontally extending part 34. It is this horizontally extending part 34 which is effective to support the substacks in the vertical path 32 as can be appreciated from the designation of these horizontal parts 34 in FIG. 2. More particularly, the fingers 25 enter the vertical path 32 in a location between the outside longitudinal edges of the first conveyor 22 and the inside longitudinal edges of the second conveyor 23. This is illustrated schematically in FIG. 3. Thus, the area of each substack between the outer longitudinal edges of the first conveyor 22 (as represented by the upper run of belt 21 in FIG. 2) and the inner longitudinal edges of the conveyor 23, (as represented by the spaced apart belts 28 and 29 also in FIG. 2) constitutes a finger engageable support portion for moving the substacks downwardly in the vertical path 32 so as to achieve a larger stack.

The path of movement of the fingers is a generally obround orbit—see the left hand portion of FIG. 2 wherein the upper and lower parts are semicircular as at 35 and 36, and connected by straight vertical runs as at 37 and 38. The preferred version of the apparatus provides an orbit which is obround only in the confronting or adjoining orbit portions—compare the orbit in the right hand portion of FIG. 2. The extreme right hand portion of this orbit lacks the straight run due to the provision of a tightener sprocket 39—the counterpart of which in the perspective showing is designated 39' in FIG. 3.

However, the basic movement of the fingers 25 is achieved by vertically aligned sprockets as at 40 and 41 (alternately 40' and 41' of FIG. 3) which provide a generally arcuate orbit portion at both the top and bottom of the orbit with a straight vertically intermediate run—as at 38.

Referring now to FIG. 5, it will be seen that a portion of the frame 10 supports a pair of bearing blocks 42 and 43 which carry shafts associated with the sprockets 40 and 41. As illustrated, a pair of sprockets are provided over which a pair of chains as at 44 are entrained so as to rigidify the finger support bars 45. It will be appreciated that other means such as timing belts and pulleys may be equally advantageously utilized in the practice of the invention. Input power to the transfer mechanism generally designated 46 in FIG. 5 is delivered to the shaft 47 associated with the sprockets 41. A bracket 48 is positionably mounted on the frame 10 (see FIG. 5) to accommodate movement of the tightener sprocket 39 when the bearing blocks 42 and 43 are changed to vary the compression at the start of a stack (relative to the top sprocket 40) or to adjust the gap between the fingers 25 and the receiving and takeaway conveyor 26 (relative to the twin sprockets 41).

As the fingers 25 descend to the bottom of the vertical path 32, they accelerate by virtue of entering the arcuate orbit and move sufficiently horizontally away—to the position 34*a* in the central bottom of FIG. 2—so as to permit the entry of the bucket 27 into the path for receiving and taking away the now completed stack in the horizontal path defined by the conveyor 26. This same advantageous acceleration of the fingers occurs at the time of entry thereof into the vertical path 32 by virtue of aligning the upper sprocket 40 generally horizontally with the path of travel of the substacks 11—see FIG. 1. Notwithstanding the rapid entry and exit from the vertical path 32, the fingers 25 descend in the path at a uniform rate so as to maintain and otherwise not disturb the accumulating substacks of web units.

In the operation of the apparatus, the substacks 11 are advanced in spaced relation along a first horizontal path, the spacing between adjacent substacks being equal to the length of each substack itself. This permits efficient operation of the packing and stacking portion of the apparatus and without the need of any speed up belts to achieve a spacing. This permits the orbital packer to move at a uniform speed throughout the orbit thereof because the spacing between substacks provides a suitable time period for return of the packer fingers 32 into packing position. Then, by virtue of the transfer mechanisms 46, the uniform action of the packer fingers 32 is utilized again without the need for a speed change. More importantly, the entire apparatus employs rotary movements so as to avoid any jarring impacts to the web units being handled.

By the instant invention where rotary fingers are mounted on an endless chain or like means for orbiting, the time and space limitations characteristic of the prior art are no longer applicable. For example, in U.S. Pat. No. 3,498,600, packers stripped individual product from a folding roll so as to build up a stack on support fingers and when the stack was completed, the stack fingers moved downwardly to deliver the completed stack to a takeaway conveyor. All of this had to occur during a limited time during which a next stack was being completed. Thus, once a stack was completed, it had to move away to the takeaway conveyor, had to be stripped and the support fingers returned at the instant the proper count was reached. All of this meant there was a definite time limitation within which all of these mechanisms had to work and given a predetermined vertical distance and speed at which the mechanism was to operate, it was not well adapted to short count products. On the other hand, the instant invention which makes use of what could be considered rotary count fingers, it is possible to use a chain with a very small pitch length and therefore a very small space between fingers and thereby accept and properly handle very short counts including individual product. Thus, the mechanism is adapted to handle any count multiples from one on up.

The invention further is versatile in providing for various spacing arrangements and speeds. The spacing between fingers (vertically as illustrated) can determine the size of the substack and this is readily achieved through the use of different pitch chain. Also, the ability to choose different pitch chain and thereby vary the vertical (as shown) spacing between fingers permits the handling of wider product. For example, and with reference to FIG. 2, if the finger spacing is determined by the radial lines 34*b* and 34*c*, a wider product can be introduced vertically into the count finger mechanism than would be the case if the finger spacing was illustrated by the fingers in the positions 34*b* and 34*d*. A similar versatility is available through changing the size of the sprockets as well as the spacing (horizontally as shown) between fingers.

Still further, the invention provides further versatility in being able to use sprockets of different diameters (as at 40' and 41' in FIG. 3). This is advantageous because the top fingers enter very rapidly while the same single index moves the bottom fingers through a much smaller angular path. This permits the acceptance of a wider product without limiting the release thereof and particularly the gradual discharge brought about through the use of the larger diameter sprocket 41'.

In summary, a variety of engineering factors can be varied to determine the optimum handling of product, these including the following:

(A) diameter of the top sprocket,
(B) diameter of the bottom sprocket,
(C) vertical distance between sprockets,
(D) horizontal distance between sprockets,
(E) length of extended fingers and therefore non-supported distance between finger pairs,
(F) continuous or indexing drive,
(G) pitch of chain
(H) direction of incoming sub-stack or single product,
(I) direction of accumulated stack discharge.

While in the foregoing specification a detailed description of an embodiment of the invention has been set down for the purpose of illustration, many variations in the details hereingiven may be made by those skilled in the art without departing from the spirit and scope of the invention.

I claim:

1. Apparatus for stacking web units including a frame, means on said frame for advancing product units along a horizontal path and then along a vertical path to a horizontally traveling receiving and takeaway conveyor wherein the units accumulated into stacks, the improvement characterized by a pair of transfer finger mechanisms on said frame, one on each side of said horizontal path, each mechanism carrying a plurality of L-shaped fingers, and means on said mechanisms for moving the fingers thereof through a generally obround orbit intersecting said horizontal path slightly inwardly of the sides thereof and defining said vertical path, said advancing means including first and second horizontally extending conveyors arranged sequentially in said horizontal path, said first conveyor being arranged to engage the central portion of said product units while said second conveyor is arranged to engage the side portions of said units and with the outside longitudinal edges of the first conveyor spaced from the inside longitudinal edges of the second conveyor to provide a finger engageable portion on each unit, said mechanisms being arranged relative to said first and second conveyors to orbit said fingers into supporting engagement with said finger engageable portions of certain of said product units.

2. The apparatus of claim 1 in which orbital packer means are provided for transferring product units from said second conveyor to said fingers.

3. The apparatus of claim 2 in which product providing means are operably associated with said advancing means to provide horizontally spaced apart product whereby a time period is provided for return of said orbital packer means to packing position and said orbital packer is adapted to move at uniform speed throughout the orbit thereof.

4. The apparatus of claim 2 in which said orbital packer is equipped with fingers moving between the inside longitudinal edges of said conveyor.

5. The apparatus of claim 1 in which said second conveyor includes a pair of endless belts for engaging the top of each product and a pair of spaced apart rails aligned with said belts for supporting said product above said vertical path.

6. The apparatus of claim 5 in which an orbital packer engages each product between said belts and rails to remove the same from supporting relation on said rails and moves the same onto said L-shaped fingers.

7. The apparatus of claim 1 in which said receiving and takeaway conveyor is arranged to contact and support the central portion of an accumulated number of product units to remove the same from support on said fingers, said receiving and takeaway conveyor being positioned adjacent the bottom of the descending portion of said generally obround orbit whereby said fingers are adapted to move rapidly out of the path of horizontal travel of said receiving and takeaway conveyor.

8. Apparatus for stacking web units including a frame, means on said frame for advancing product units along a horizontal path and then along a vertical path to a horizontally traveling receiving and takeaway conveyor wherein the units accumulated into stacks, the improvement characterized by a pair of transfer finger mechanisms on said frame, one on each side of said horizontal path, each mechanism carrying a plurality of L-shaped fingers, and means on said mechanisms for moving the fingers thereof through a generally obround orbit intersecting said horizontal path slightly inwardly of the sides thereof and defining said vertical path, said L-shaped fingers having a first part connected to said means and extending in the plane of said orbit and radially away therefrom, and a second part perpendicular to said first part and spaced from said means.

9. The structure of claim 8 in which said second part has a length greater than that of a substack measured in the direction of substack advance in said horizontal path.

10. The structure of claim 9 in which each said finger is a rod.

* * * * *